US007228832B2

(12) United States Patent
Novak

(10) Patent No.: US 7,228,832 B2
(45) Date of Patent: Jun. 12, 2007

(54) INTERNAL COMBUSTION ENGINE WITH TRANSLATABLE CAMSHAFT

(75) Inventor: Keith A Novak, Tyler, TX (US)

(73) Assignee: Tecumseh Products Company, Tecumseh, MI (US)

( * ) Notice: Subject to any disclaimer, the term of this patent is extended or adjusted under 35 U.S.C. 154(b) by 339 days.

(21) Appl. No.: 10/806,786

(22) Filed: Mar. 23, 2004

(65) Prior Publication Data

US 2005/0211212 A1 Sep. 29, 2005

(51) Int. Cl.
*F01M 1/06* (2006.01)

(52) U.S. Cl. ..... 123/90.34; 123/90.15; 123/90.16

(58) Field of Classification Search ..... 123/90.15, 123/90.16, 90.17, 90.18, 90.27, 90.31, 90.6, 123/90.34
See application file for complete search history.

(56) References Cited

U.S. PATENT DOCUMENTS 4,018,203 A 4/1977 Legros ..... 123/182
4,805,565 A 2/1989 Sato et al. ..... 123/90.6
5,301,643 A 4/1994 Gracyalny ..... 123/198 D
6,250,271 B1 6/2001 Ikuma et al. ..... 123/182.1
6,295,959 B1 10/2001 Molina et al. ..... 123/90.31
6,474,281 B1 * 11/2002 Walters ..... 123/90.18

* cited by examiner

*Primary Examiner*—Ching Chang
(74) *Attorney, Agent, or Firm*—Baker & Daniels LLP

(57) ABSTRACT

An internal combustion engine having a camshaft which is translatable between first and second positions to control an engine operating characteristic. The camshaft is rotationally driven from the engine crankshaft, and includes an oil pump member in fluid communication with the oil sump of the engine. During rotation of the camshaft, the oil pump member pumps oil from the oil sump to various lubrication points in the engine, and also generates an oil pressure which acts upon at least a portion of the camshaft. At low engine speeds, the oil pressure is insufficient to translate the camshaft. However, at high engine speeds, the oil pressure is sufficient to translate the camshaft axially during running of the engine, and the camshaft returns to its initial position when the speed of the engine decreases. Translation of the camshaft may facilitate an automatic compression and/or vacuum release feature, a low and high speed cam switching feature, or a low oil shutdown feature, for example.

14 Claims, 10 Drawing Sheets

INTERNAL COMBUSTION ENGINE WITH TRANSLATABLE CAMSHAFT

BACKGROUND OF THE INVENTION

1. Field of the Invention

The present invention relates to small internal combustion engines of the type used in a variety of applications, such as lawnmowers, generators, pumps, tillers, pressure washers and other lawn and garden implements, or in small utility vehicles such as riding lawnmowers, lawn tractors, and the like, as well as in sport vehicles.

2. Description of the Related Art

Generally, the intake and exhaust valves of small internal combustion engines may be actuated directly by a camshaft located in the cylinder head, or may be actuated indirectly through the use of rocker arms, tappets, or other similar means. For example, in many existing L-head and overhead valve ("OHV") engines, the crankshaft drives a camshaft which is located within the crankcase and is disposed parallel to the crankshaft, and lobes on the camshaft actuate tappets, lifters, push rods and/or rocker arms to open and close the valves. In overhead cam ("OHC"), engines, a camshaft located in the cylinder head of the engine is driven from the crankshaft, and includes lobes thereon which directly actuate intake and exhaust valves.

At engine cranking speeds during engine starting, the intake and exhaust valves are both closed as the piston rises in its compression stroke toward its top dead center position, and substantial pressure is built up in the combustion chamber which resists movement of the piston toward its top dead center position. This pressure must be overcome to crank the engine for starting, and typically requires a substantial amount of force to be exerted by the operator, such as by pulling on the rope of a recoil starter. Therefore, small internal combustion engines typically include a type of compression release mechanism to aid in engine starting.

Also, at engine cranking speeds during engine starting, the intake and exhaust valves are both closed as the piston descends in its expansion stroke toward its bottom dead center position. During this stroke, the piston descends against a vacuum which is produced within the combustion chamber of the engine, thereby creating a vacuum force which resists downward movement of the piston and which must be overcome by the operator to start the engine. Therefore, small internal combustion engines may also include a type of combustion chamber venting arrangement, or "vacuum release" mechanism to aid in engine starting.

Compression release mechanisms for small internal combustion engines are usually operable at cranking speeds to prevent the exhaust or intake valve from fully closing as the piston approaches its top dead center position, thereby allowing venting of pressure from the combustion chamber. Vacuum release mechanisms for small internal combustion engines are also operable at cranking speeds to prevent the exhaust or intake valve from fully closing as the piston descends from its top dead center position, thereby allowing venting of air into the combustion chamber. In this manner, cranking of the engine is much easier and requires less force to be exerted by the operator. When the engine reaches a predetermined speed after starting, the compression and/or vacuum release mechanism is automatically rendered inoperative, such that the exhaust or intake valve fully seats or closes as the piston approaches and/or descends from its top dead center position to allow combustion to proceed in a normal manner.

Many known compression release mechanisms and vacuum release mechanisms include a large number of individual, moving parts, and can be somewhat mechanically complex. Although many known compression release mechanisms and vacuum release mechanisms operate well, the number of parts from which these mechanisms are made increases the cost and difficulty of assembling such mechanisms.

What is needed is a compression and/or vacuum release mechanism for small internal combustion engines which includes a relatively few number of parts, is durable, and which is compact in construction.

Additionally, it is known that for many internal combustion engines, the optimum valve operating characteristics may vary between low engine speeds and high engine speeds. Some internal combustion engines include low speed cams having a first cam profile for actuating the intake and exhaust valves at low engine speeds, and high speed cams having a second cam profile for actuating the intake and exhaust valves at high engine speeds. These engines incorporate cam switching mechanisms in which the low speed cams are used at low engine speeds, and the high speed cams are used high engine speeds. Typically, however, cam switching mechanisms are mechanically very complex and expensive to manufacture, such that same are usually not used in small internal combustion engines.

Thus, a further need is for a cam switching mechanism for small internal combustion engines which is an improvement over the foregoing.

Additionally, some known internal combustion engines incorporate a low oil level warning and/or a low oil shut down feature which is responsive to the oil level in the engine crankcase. When the oil level falls below a level which is necessary to adequately lubricate the moving parts of the engine, such that damage to the engine could potentially occur, a low oil level warning is signaled to the operator or the engine is automatically shut down to prevent damage to the engine. Typical low oil level warning and/or low oil shutdown mechanisms rely upon direct oil measurement devices, such as float valves or electronic sensors disposed in the crankcase, which add cost to the engine.

What is needed is a low oil shutdown feature for small internal combustion engines which is an improvement over the foregoing.

SUMMARY OF THE INVENTION

The present invention provides an internal combustion engine having a camshaft which is translatable between first and second positions to control an engine operating characteristic. The camshaft is rotationally driven from the engine crankshaft, and includes an oil pump member in fluid communication with the oil sump of the engine. During rotation of the camshaft, the oil pump member pumps oil from the oil sump to various lubrication points in the engine, and also generates an oil pressure which acts upon at least a portion of the camshaft. At low engine speeds, the oil pressure is insufficient to translate the camshaft. However, at high engine speeds, the oil pressure is sufficient to translate the camshaft axially during running of the engine, and the camshaft returns to its initial position when the speed of the engine decreases. Translation of the camshaft may facilitate an automatic compression and/or vacuum release feature, a low and high speed cam switching feature, or a low oil shutdown feature, for example.

In one embodiment, the camshaft includes a compression and/or vacuum release member which, when the camshaft is in a first position corresponding to engine cranking speeds, is in contact with an intake or exhaust valve of the engine to provide a compression and/or vacuum release feature to aid in starting the engine. After the engine starts, rapid rotation of the camshaft causes the pump member to build sufficient oil pressure to translate the camshaft axially and move the compression and/or vacuum release member out of contact with the intake or exhaust valve to automatically disable the compression or vacuum release feature.

In another embodiment, the camshaft includes a low oil shutdown member on the camshaft which, during engine running speeds, is disposed out of engagement with an intake or exhaust valve of the engine to allow the engine to run in a normal manner. When an oil level in the engine crankcase falls below a desired level, the oil pressure generated by the oil pump member falls, allowing the camshaft to translate axially by gravity and/or by a return spring and move the low oil shutdown member into engagement with the intake or exhaust valve of the engine, thereby venting the combustion chamber during at least a portion of the compression and/or expansion stroke of the piston to disable running of the engine. In this manner, an automatic low oil shutdown feature is provided.

In a further embodiment, a low and high speed cam switching feature is provided, wherein the camshaft includes at least one low speed cam and at least one high speed cam. During low engine running speeds, the camshaft is disposed in a first position in which the low speed cams actuate the intake and exhaust valves of the engine according to a desired low speed timing of the engine. When the engine reaches high speeds, rapid rotation of the camshaft causes the pump member build sufficient oil pressure to translate the camshaft axially to a second position, shifting the low speed cams out of engagement with the intake and exhaust valves and concurrently shifting the high speed cams into engagement with the intake and exhaust valves to actuate the intake and exhaust valves according to a desired high speed timing for the engine.

In one form thereof, the present invention provides an internal combustion engine, including an engine housing; a crankshaft, connecting rod, and piston assembly disposed within the engine housing, the piston reciprocatable within a cylinder bore to define a variable volume combustion chamber; an oil sump disposed within the engine housing and containing oil; a camshaft rotatably supported within the engine housing in timed driven relationship with the crankshaft, the camshaft translatable axially between first and second positions, the camshaft further including at least one cam lobe periodically engaging a valve; and at least one auxiliary valve actuator axially spaced from the cam lobe, the auxiliary valve actuator engaging the valve in the first camshaft position and not engaging the valve in the second camshaft position; and an oil pump in fluid communication with the oil sump, oil pressure generated by said oil pump acting upon at least at portion of the camshaft to translate the camshaft from the first position to the second position at high engine speeds, the oil pressure insufficient at low engine speeds to translate the camshaft from the first position to the second position.

In another form thereof, the present invention provides an internal combustion engine, including an engine housing containing an oil sump having a volume of oil, the engine housing further including a cavity in fluid communication with the oil sump; a crankshaft, connecting rod, and piston assembly disposed within the engine housing, the piston reciprocatable within a cylinder bore to define a variable volume combustion chamber; a camshaft rotatably supported in the engine housing in timed driven relationship with the crankshaft, the camshaft translatable axially between a first position and a second position, the camshaft further including at least one cam lobe periodically engaging a valve; an auxiliary valve actuator axially spaced from the cam lobe, the auxiliary valve actuator engaging the valve in the first camshaft position and not engaging the valve in the second camshaft position; and an oil pump member rotatably disposed within the cavity, oil pressure generated by the oil pump member acting upon the oil pump member at high engine speeds to translate the camshaft from the first position to the second position.

In a further form thereof, the present invention provides an internal combustion engine, including an engine housing; a crankshaft, connecting rod, and piston assembly disposed within the engine housing, the piston reciprocatable within a cylinder bore to define a variable volume combustion chamber; an oil sump disposed within the engine housing and containing oil; a camshaft rotatably supported within the engine housing in timed driven relationship with the crankshaft, the camshaft translatable axially between first and second positions, the camshaft further including at least one valve actuator periodically engaging a valve; and at least one auxiliary valve actuator spaced from the valve actuator, the auxiliary valve actuator engaging the valve in the first camshaft position and not engaging the valve in the second camshaft position; and means for translating the camshaft between the first and second positions responsive to engine speeds.

In a further form thereof, the present invention provides an internal combustion engine, including an engine housing; a crankshaft, connecting rod, and piston assembly disposed within the engine housing, the piston reciprocatable within a cylinder bore to define a variable volume combustion chamber; an oil sump disposed within the engine housing and containing oil; a camshaft rotatably supported within the engine housing in timed driven relationship with the crankshaft, the camshaft translatable axially between first and second positions, the camshaft further including at least one low speed cam lobe periodically engaging a valve in the first camshaft position; and at least one high speed cam lobe periodically engaging the valve in the second camshaft position; and an oil pump disposed within the engine housing in fluid communication with the oil sump, oil pressure generated by the oil pump acting upon at least at portion of the camshaft to translate the camshaft from the first position to the second position at high engine speeds, the oil pressure insufficient at low engine speeds to translate the camshaft from the first position to the second position.

In a further form thereof, the present invention provides a method of operating an internal combustion engine having a camshaft with at least one cam lobe actuating at least one valve, including the step of translating the camshaft axially responsive to oil pressure between a first position in which an auxiliary valve actuator on the camshaft engages a valve and a second position in which the auxiliary valve actuator does not engage the valve.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplifications set out herein illustrate preferred embodiments of the invention, and such exemplifications are not to be construed as limiting the scope of the invention any manner.

DETAILED DESCRIPTION

Figure 1A:
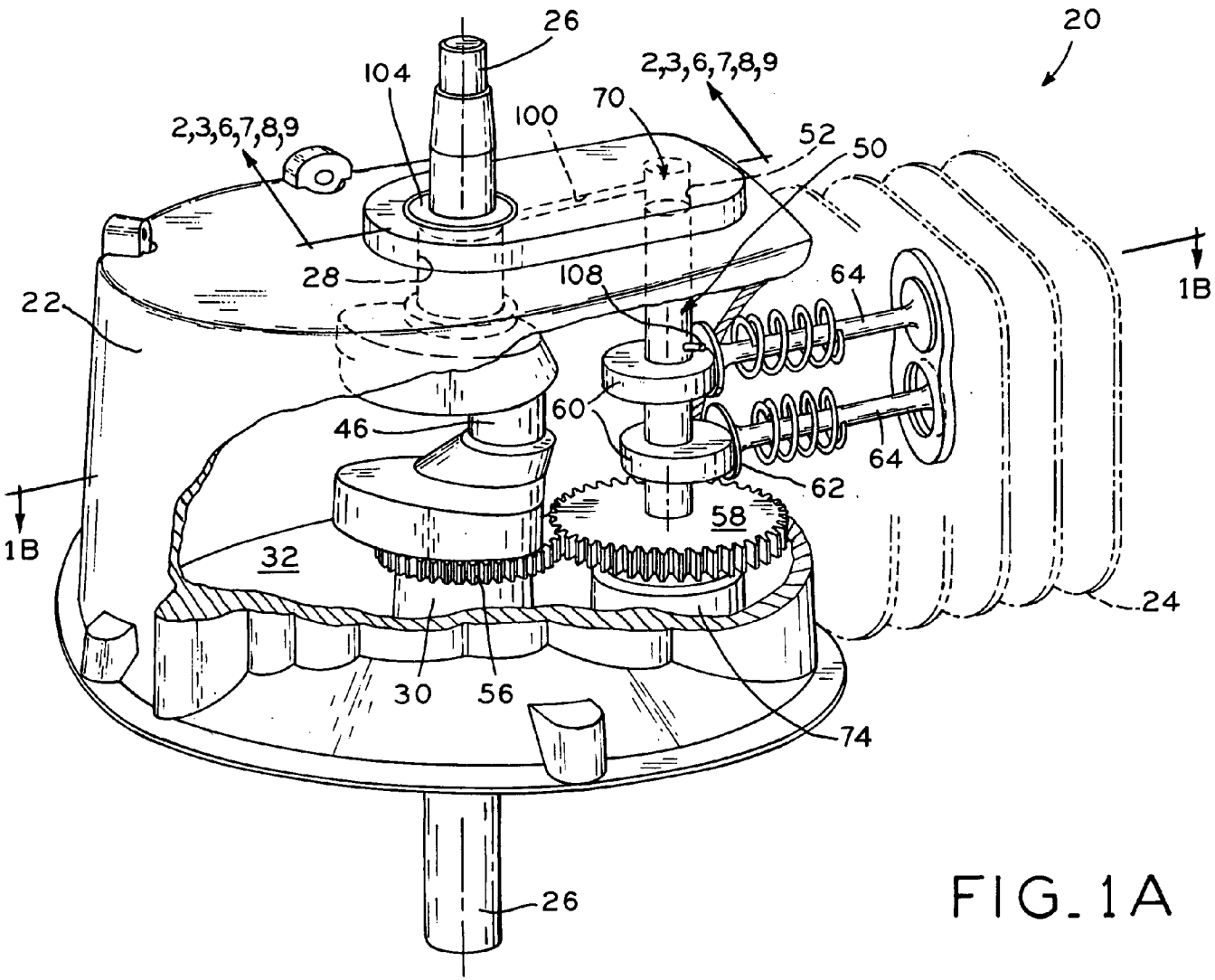
FIG. 1A is perspective cutaway view of an exemplary internal combustion engine including a translatable camshaft according to the present invention.
Figure 1B:
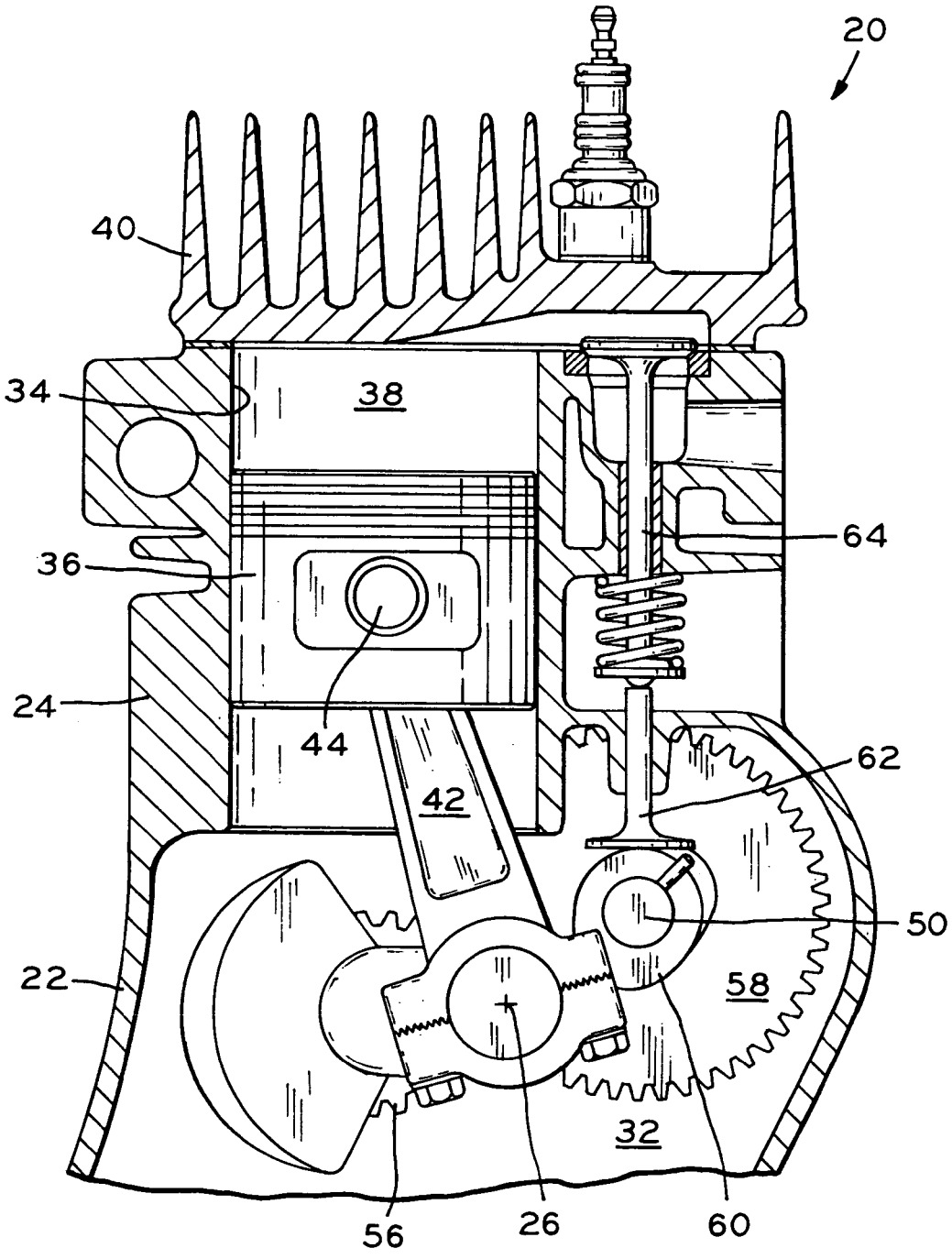
FIG. 1B is a horizontal sectional view of the engine of FIG. 1A, along line 1B—1B of FIG. 1A.

Referring to FIGS. 1A and 1B, internal combustion engine 20 is shown, which generally includes an engine housing including crankcase 22, and cylinder block 24 attached to crankcase 22. Except as described herein, engine 20 is similar in overall construction to the engines which are disclosed in U.S. Pat. No. 6,295,959 and in U.S. patent application Ser. No. 10/322,091, entitled ENGINE LUBRICATION SYSTEM, filed on Dec. 17, 2002, each assigned to the assignee of the present invention, the disclosures of which are expressly incorporated herein by reference. As discussed below, engine 20 is configured as a side valve or "L-head" engine; however, the present invention is equally applicable to engines which are configured as overhead valve ("OHV") engines and overhead cam ("OHC") engines.

Crankshaft 26 is disposed vertically in crankcase 24, and is rotatably supported by upper crank bearing 28 and lower crank bearing 30 carried in crankcase 24. Alternatively, crankshaft 26 may be disposed horizontally. Crankcase 24 includes oil sump 32 containing a quantity of lubricating oil therein. Engine 20 further includes a cylinder bore 34 within cylinder block 24 in which piston 36 is slidably disposed to define a variable volume combustion chamber 38 between piston 36 and cylinder head 40 of cylinder block 24. Connecting rod 42 is connected at its opposite ends to wrist pin 44 (FIG. 1B) of piston 36 and to crank pin 46 (FIG. 1A) of crankshaft 26.

Figure 2:
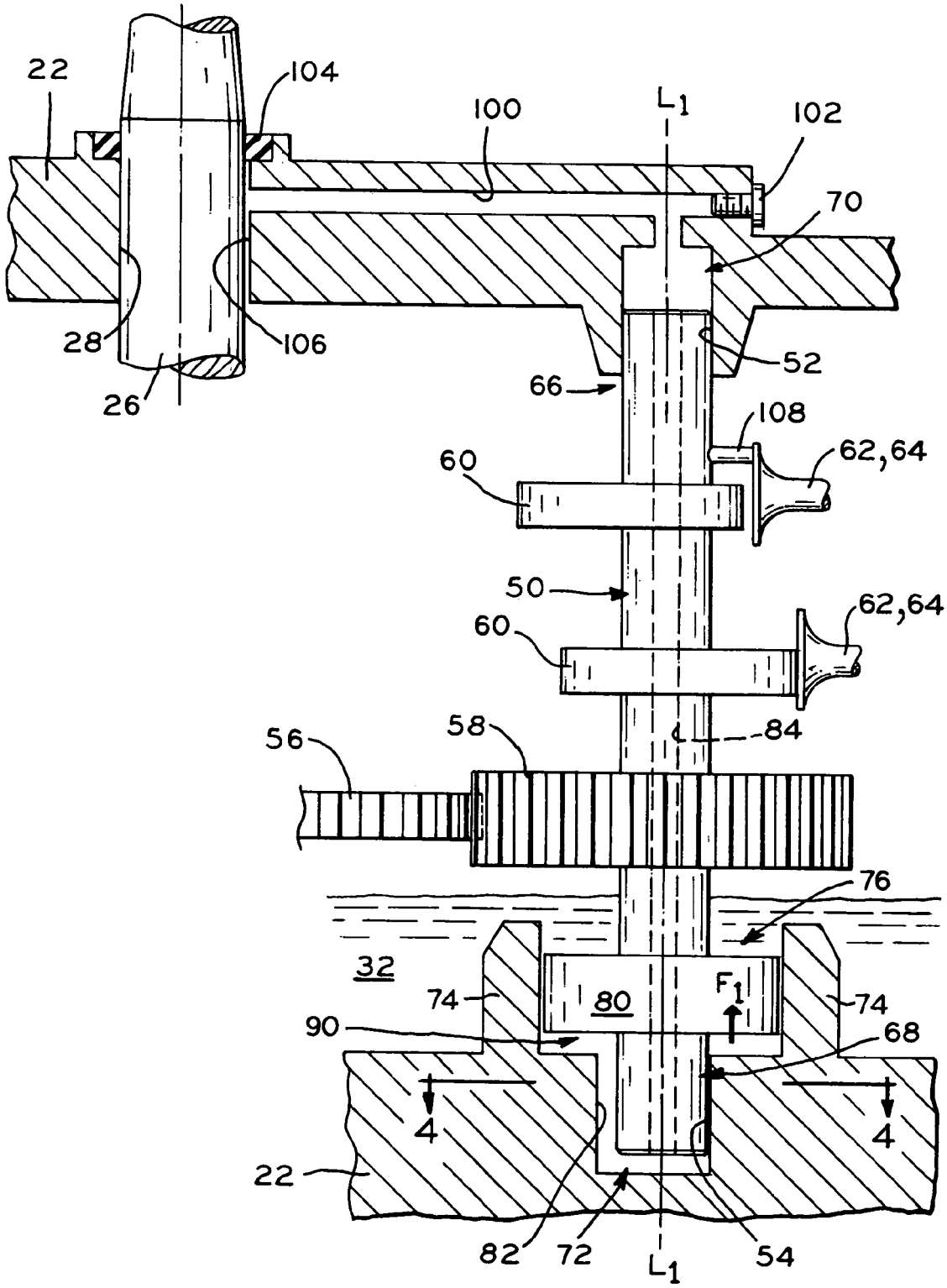
FIG. 2 is a sectional view along line 2—2 of FIG. 1A, wherein the translatable camshaft implements a compression and/or vacuum release feature, the camshaft disposed in a first position corresponding to engine cranking speeds.

Referring additionally to FIG. 2, engine 20 additionally includes camshaft 50 disposed vertically and parallel to crankshaft 26, with camshaft 50 supported for rotation within upper camshaft bearing 52 and lower camshaft bearing 54 carried in crankcase 22. Alternatively, as discussed below, camshaft 50 may be oriented horizontally. Crankshaft 26 includes drive gear 56 thereon which meshes with cam gear 58 on camshaft 50, such that camshaft 50 is rotatably driven in timed relationship with crankshaft 26. Usually, in a four-cycle engine, drive gear 56 drives cam gear 58 at a 2:1 ratio, wherein crankshaft 26 and drive gear 56 rotate twice for each rotation of camshaft 50 and cam gear 58. Drive gear 56 and cam gear 58 are preferably spur gears, which facilitate axial movement of cam gear 58 with respect to drive gear 56, as described below. Camshaft 50 includes a pair of intake and exhaust cam lobes 60 thereon which periodically actuate tappets 62 of intake and exhaust valves 64 during rotation of camshaft 50 to open and close intake and exhaust valves 64 during running of engine 20 for allowing an air/fuel combustion mixture into combustion chamber 38 of engine 20 and for venting the products of combustion out of combustion chamber 38, respectively. Cam lobes 60 may be separate components mounted to camshaft 50, or alternatively, cam lobes 60 may be integrally cast or molded with camshaft 50 from a suitable metal or plastic, for example.

Figure 4:
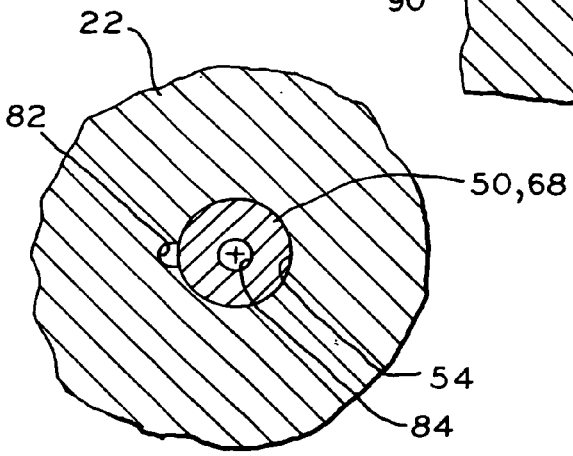
FIG. 4 is a sectional view along line 4—4 of FIG. 2.

Referring to FIG. 2, camshaft 50 includes upper end 66 rotatably supported by upper camshaft bearing 52, and lower end 68 rotatably supported by lower camshaft bearing 54. Upper camshaft bearing 52 includes a clearance space 70, accommodating axial translation of camshaft 50 along longitudinal axis $L_1$—$L_1$ of camshaft 50, as described below. Similarly, lower camshaft bearing 54 includes clearance space 72, accommodating axial translation of camshaft 50. An annular wall 74 of crankcase 22 defines a circular cavity 76 disposed above lower camshaft bearing 54 which is in fluid communication with oil sump 32. Pump member 80 is mounted to camshaft 50 for rotation therewith, and is received within cavity 76 with the outer circumference of pump member 80 disposed closely adjacent wall 74 of cavity 76. In this manner, pump member substantially encloses cavity 76, forming a substantially enclosed oil space 90 between pump member 80 and lower camshaft bearing 54. Referring additionally to FIG. 4, an oil passage 82 extends along lower camshaft bearing 54 and fluidly communicates cavity 76 and oil space 90 with clearance space 72 and lower end 68 of camshaft 50. Camshaft 50 further includes a longitudinal bore 84 therethrough, which is disposed along longitudinal axis $L_1$—$L_1$ of camshaft 50 and which fluidly communicates clearance space 72 and lower end 68 of camshaft 50 with clearance space 70 and upper end 66 of camshaft 50.

Figure 5A:
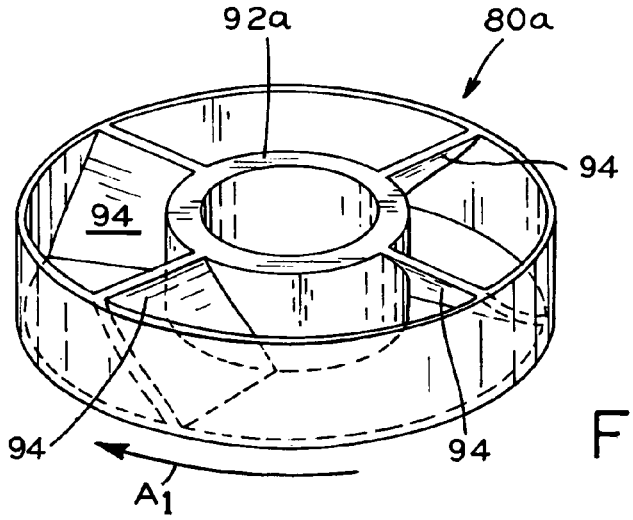
FIG. 5A is a perspective view of a first exemplary pump member.
Figure 5B:
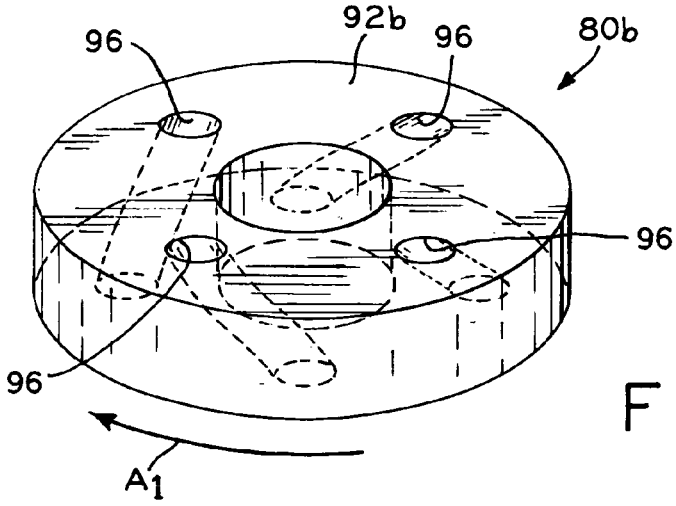
FIG. 5B is a perspective view of a second exemplary pump member.
Figure 5C:
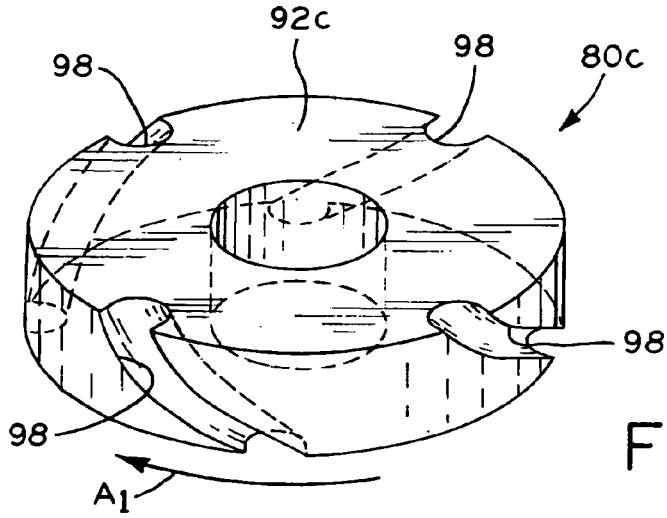
FIG. 5C is a perspective view of a third exemplary pump member.

As shown in FIGS. 5A–5C, pump member 80 may take may forms; however, regardless of the type of pump member 80 used, pump member 80 is generally operable to pump oil from oil sump 32 into an oil space 90. Pump member 80 may be a separate member mounted to camshaft 50, or alternatively, may be integrally formed with camshaft 50.

In FIG. 5A, pump member 80*a* is shown as an impeller, including body portion 92*a* attached to camshaft 50, and a plurality of blades 94 extending radially outwardly from body portion 92*a*. Upon rotation of pump member 80*a* in the direction of arrow $A_1$ along with camshaft 50, blades 94 force oil from oil sump 32 into oil space 90. An increase in oil pressure in oil space 90 imposes an upward force upon body portion 92*a* and blades 94 of pump member 80*a*, causing pump member 80*a* to "float" upon the oil within oil space 90.

In FIG. 5B, pump member 80*b* includes body portion 92*b* mounted to camshaft 50, and a plurality of angled or curved bores 96 therein. Upon rotation of pump member 80*b* in the direction of arrow $A_1$ along with camshaft 50, oil is forced from oil sump 32 downwardly through bores 96 into oil space 90. An increase in oil pressure in oil space 90 imposes an upward force upon body portion 92*b* of pump member 80*b*, causing pump member 80*b* to "float" upon the oil within oil space 90.

In FIG. 5C, pump member 80*c* includes body portion 92*c* mounted to camshaft 50, and a plurality of angled or curved grooves 98 therein at the outer circumference of body portion 92*c*. Upon rotation of pump member 80*c* in the direction of arrow $A_1$ along with camshaft 50, oil is forced from oil sump 32 downwardly through grooves 98 into oil space 90. An increase in oil pressure in oil space 90 imposes an upward force upon body portion 92*c* of pump member 80*c*, causing pump member 80*c* to "float" upon the oil within oil space 90.

Referring to FIG. 2, upper camshaft bearing 52 is in fluid communication with an oil passage 100 provided in crankcase 22, which communicates upper camshaft bearing 52 with upper crank bearing 28. Oil passage 100 may be formed by drilling a bore in crankcase 22, followed by closing the open end of the bore with a threaded plug member 102 or other device, for example. Upper crank bearing 28 includes oil seal 104 to prevent the escape of oil from crankcase 22, and also includes an oil groove 106 in fluid communication with the interior of crankcase 22.

Figure 3:
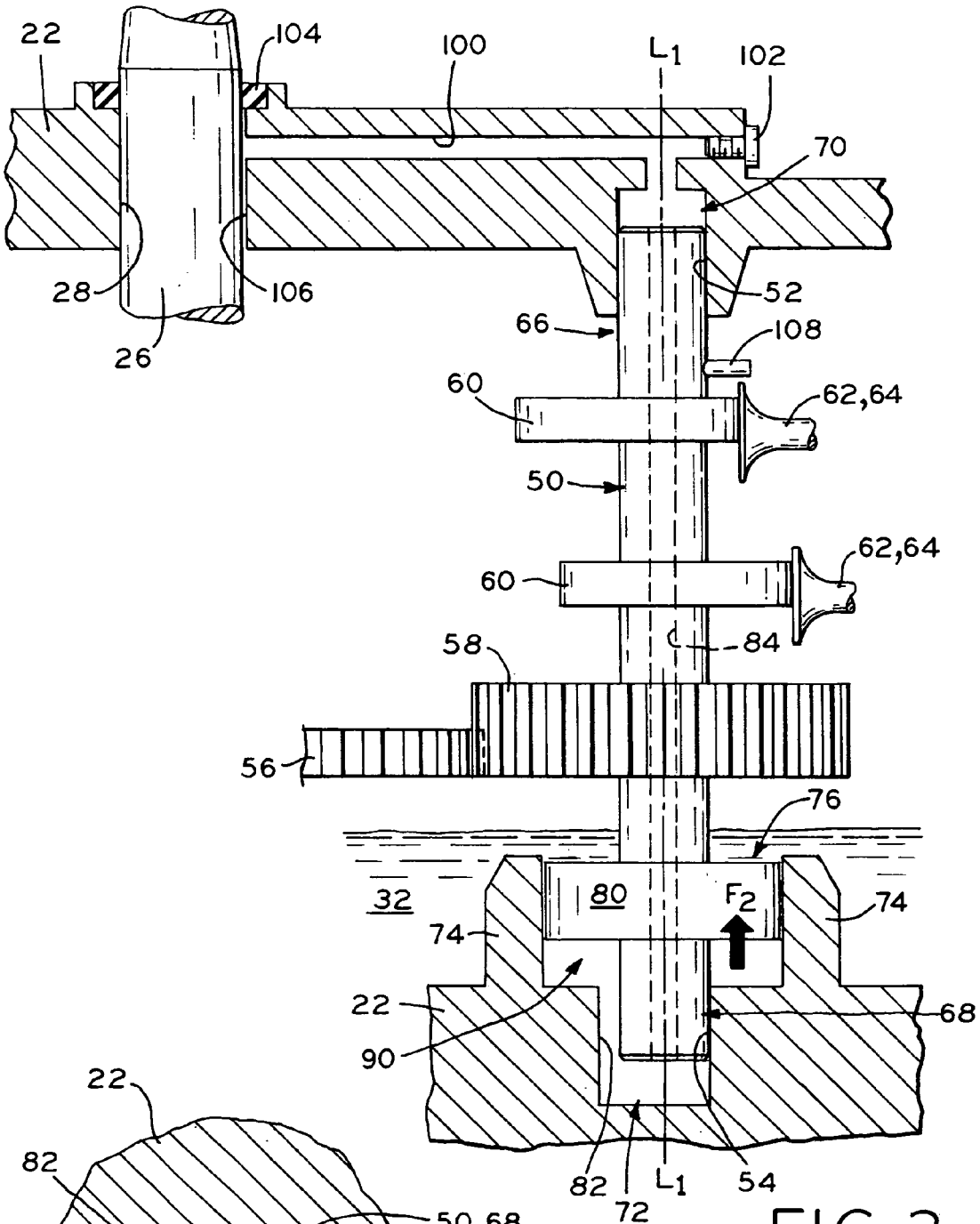
FIG. 3 is a sectional view along line 3—3 of FIG. 1A, showing the compression and/or vacuum release feature of FIG. 2, the camshaft disposed in a second position corresponding to engine running speeds.

Referring to FIGS. 2 and 3, the general operation of pump member 80 to pump oil from oil sump 32 for engine lubrication and to translate camshaft 50 axially during running of engine 20 will now be described. At low engine speeds corresponding to the cranking of engine 20 for starting, or during low speed operation of engine 20, for example, camshaft 50 is disposed in a first or lower position, shown in FIG. 2, and cam gear 58 is rotatably driven by drive gear 56 of crankshaft 26 to rotate camshaft 50 at a low speed. Pump member 80 rotates with camshaft 50 to pump oil from oil sump 32 into oil space 90, and thence through oil passage 82 to clearance space 72 in lower camshaft bearing 54 beneath lower end 68 of camshaft 50. Lower camshaft bearing 54 is lubricated by the oil which passes through oil passage 82. Oil is forced upwardly from clearance space 72 through longitudinal bore 84 in camshaft 50 to clearance space 70 in upper camshaft bearing 52, where the oil lubricates upper camshaft bearing 52. Oil is further forced through oil passage 100 to upper crank bearing 28, where oil passes through oil groove 106 to lubricate upper crank bearing 28 before dripping back to oil sump 32 in crankcase 22.

The rotation of pump member 80 and the pumping of oil from oil sump 32 into oil space 90 also generates an oil pressure acting on the side of pump member 80 opposite cam gear 58, which oil pressure imposes a first force $F_1$ acting upon pump member 80 and the lower end 68 of camshaft 50 to push camshaft 50 axially upwardly along longitudinal axis $L_1$—$L_1$ of camshaft 50. However, at low engine running speeds this oil pressure and the resulting force $F_1$ is insufficient to overcome the weight of camshaft 50, and camshaft 50 remains in its first or lower position shown in FIG. 2. Further, a camshaft return spring 112 (FIGS. 6–9) may optionally be provided to bias camshaft 50 toward its first or lower position.

However, when the speed of engine 20 increases, such as when engine 20 reaches running speeds, the faster rotation of pump member 80 causes the oil pressure within oil space 90 to build, imposing a second, greater force $F_2$ which acts upon pump member 80 and the lower end 68 of camshaft 50. Thus, camshaft 50 translates axially along its longitudinal axis $L_1$—$L_1$ from its first or lower position, shown in FIG. 2, to its second or upper position, shown in FIG. 3. As shown between FIGS. 2 and 3, upper and lower clearance spaces 70 and 72 in upper and lower camshaft bearings 52 and 54, respectively, accommodate translation of camshaft 50 between its first and second positions. Also, as shown between FIGS. 2 and 3, upon translation of camshaft 50, cam gear 58 translates with respect to drive gear 56. Drive gear 56 and cam gear 58 are preferably spur gears which include gear teeth having surfaces which are parallel to the axes of crankshaft 26 and camshaft 50. In this manner, translation of cam gear 58 relative to drive gear 56 is most easily facilitated while drive gear 56 and cam gear 58 are in meshing, driving relationship.

During running of engine 20 at high speeds, the oil pressure and resulting force $F_2$ generated by pump member 80 within oil space 90 is sufficient to maintain camshaft 50 in the second or upper position shown in FIG. 3. In other words, the volume of oil pumped through bore 84 of camshaft 50 to lubricate the various lubrication points of engine 20, as described above, is less than the pumping output of pump member 80. Upon engine shutdown or a decrease in engine speed, the rotational speed of camshaft 50 and pump member 80 decreases, and the oil pressure within oil space 90 beneath pump member 80 decreases, allowing camshaft 50 to translate axially by gravity and/or by the bias of spring 112 (FIGS. 6–9) from its second or upper position, shown in FIG. 3, back to its first or lower position shown in FIG. 2.

Referring to FIGS. 2, 3, and 6–9, various exemplary engine functions or engine operating characteristics will be described below which are facilitated by the axial translation of camshaft 50 in the manner which has been described above.

Referring first to FIGS. 2 and 3, camshaft 50 includes an auxiliary cam actuator in the form of release member 108, which may comprise a compression release member and/or a vacuum release member. Release member 108 is a cam-like projection or lobe which is located proximate, and axially spaced from, one of cam lobes 60 on camshaft 50, and release member 108 projects outwardly beyond at least a portion of the base circle of the cam lobe 60. The size and shape of release member 108 may vary, and release member 108 may be a separate member mounted on camshaft 50 or may be integrally formed with camshaft 50. As shown in FIG. 2, at low engine speeds release member 108 contacts a tappet 62 of an intake or exhaust valve 64 to unseat the valve 64 during the compression or the expansion stroke of piston 36. In this manner, at low engine speeds, gases in combustion chamber 38 are vented during a compression stroke of piston 36, or gases are allowed into combustion chamber 38 during an expansion stroke of piston 36. Thus, release member 108 provides a compression release feature or a vacuum release feature at low engine speeds to aid in cranking engine 20 for starting. The construction and operation of various compression and vacuum release members is discussed in detail in U.S. Pat. Nos. 6,394,054, 6,439,187, 6,536,393, and 6,539,906, each assigned to the assignee of the present invention, the disclosures of which are expressly incorporated herein by reference. Alternatively, camshaft 50 may include a pair of release members 108, each disposed adjacent a cam lobe 60, for providing both a compression release and a vacuum release effect at low engine speeds. Also, depending upon the particular shape of release member 108, a single release member 108 may provide compression release, vacuum release, or both compression and vacuum release.

After engine 20 starts, camshaft 50 translates axially from its first position, shown in FIG. 2, to its second position, shown in FIG. 3, in the manner described above, and release member 108 is brought out of engagement with the tappet 62 of valve 64, such that release member 108 no longer contacts tappet 62 during running of engine 20, and the actuation of valve 64 by cam lobe 60 may proceed in a normal manner. Upon engine shutdown, a decrease in engine speed allows camshaft 50 to translate from its second position, shown in FIG. 3, back to its first position, shown in FIG. 2, in the manner described above, and release member 108 is brought back into engagement with tappet 62 to provide the compression and/or vacuum release effect, thereby interrupting the conventional combustion process to aid in stopping engine 20.

Figure 6:
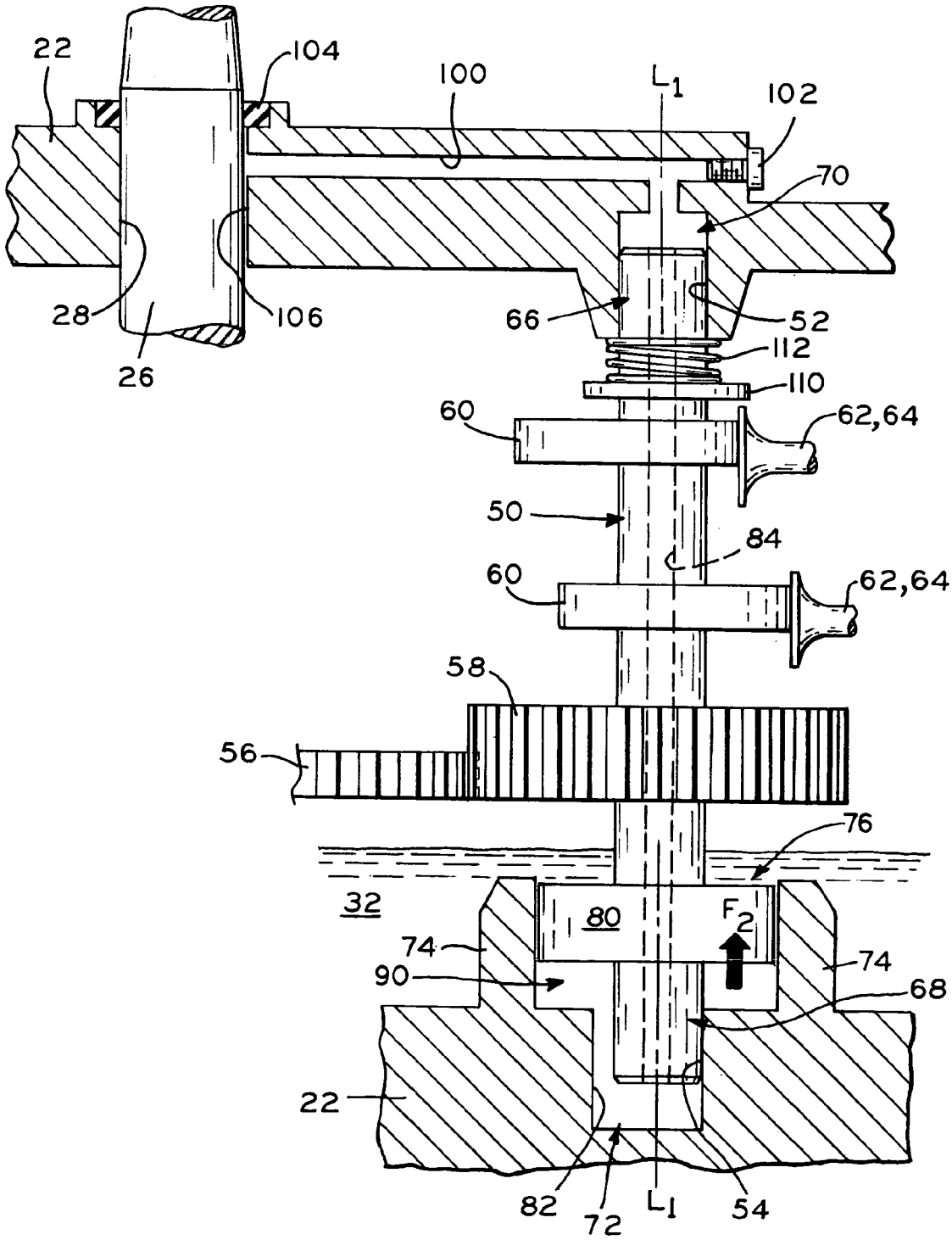
FIG. 6 is a sectional view along line 6—6 of FIG. 1A, wherein the translatable camshaft implements a low oil shutdown feature, the camshaft disposed in a second position corresponding to engine running speeds.
Figure 7:
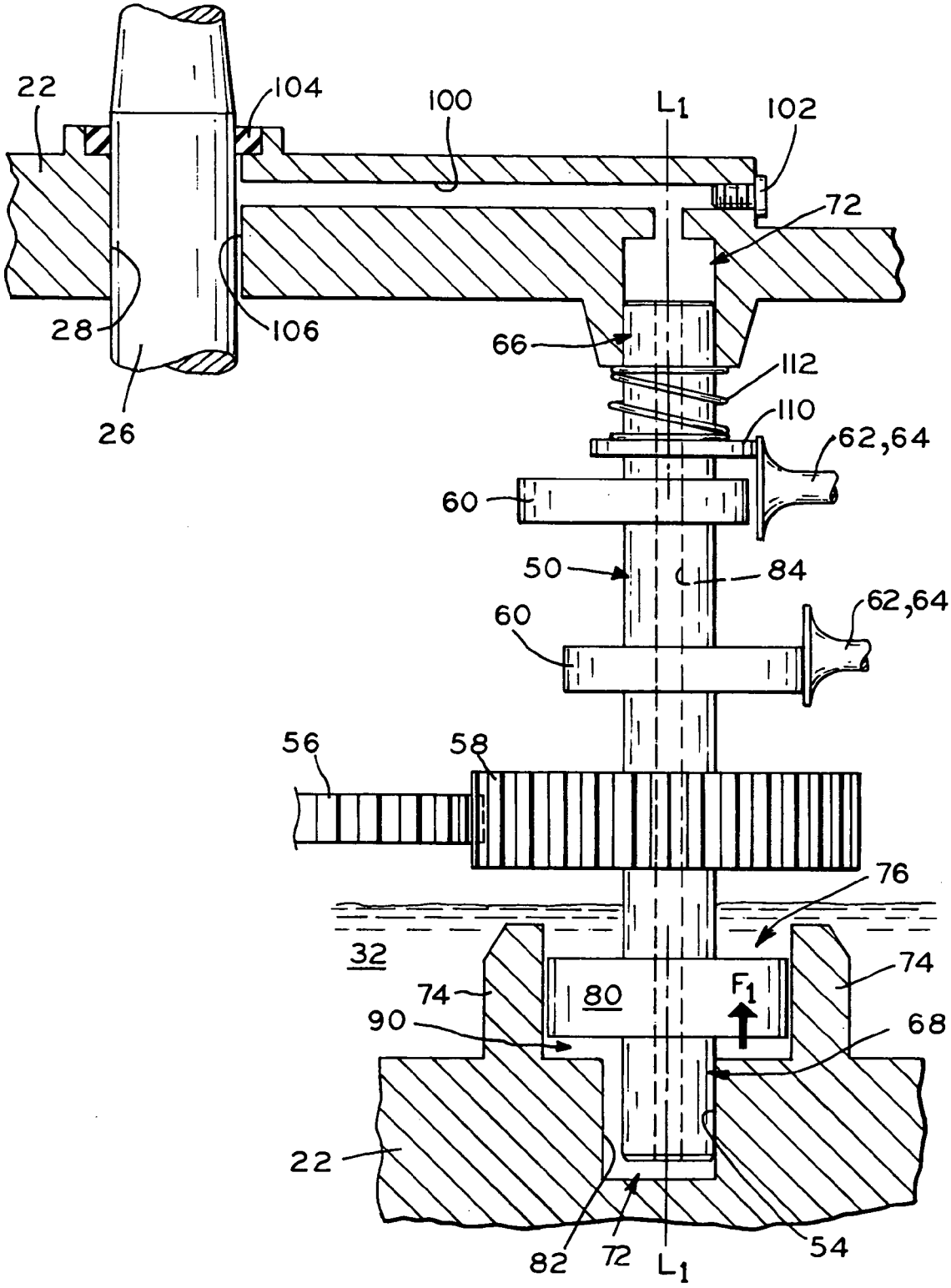
FIG. 7 is a sectional view along line 7—7 of FIG. 1A, showing the low oil shutdown feature of FIG. 6, the camshaft disposed in a first position corresponding to low engine speeds.

In FIGS. 6 and 7, a low oil shutdown feature is provided for engine 20. In this embodiment, camshaft 50 includes an auxiliary valve actuator in the form of low oil shutdown member 110, which is shown herein as a plate-type member attached to camshaft 50 adjacent cam lobe 60, which projects radially outwardly beyond at least a portion of the base circle of cam lobe 60. Optionally, camshaft return spring 112 is provided, which is shown captured under compression between upper camshaft bearing 52 and low oil shutdown member 110, with spring 112 normally biasing camshaft 50 toward its first or lower position, as shown in FIG. 7.

At engine running speeds, camshaft 50 is translated axially against the bias force of spring 112 to its second or upper position, shown in FIG. 6, in the manner described above, and low oil shutdown member 110 is disposed out of alignment with tappet 62 of intake or exhaust valve 64. In this position, the bias force of spring 112 is overcome by the oil pressure in oil space 90 and the resulting force $F_2$, and spring 112 is compressed. In this position, only cam lobe 60 engages tappet 62 of valve 64, and combustion in combustion chamber 38 of engine 20 may proceed in a normal manner during running of engine 20.

However, if the oil level in oil sump 32 should fall beneath a desired level during running of engine 20, pump member 80 will no longer be able to pump a sufficient volume of oil into oil space 90 to support camshaft 50 in its second or upper position during running of engine 20. When this occurs, spring 112 and/or the weight of camshaft 50 translate camshaft 50 axially from its second or upper position, shown in FIG. 6, to its first or lower position, shown in FIG. 7, overcoming the reduced force $F_1$ on pump member 80 and camshaft 50 which is imposed by the low oil pressure in oil space 90. Translation of camshaft 50 to the position shown in FIG. 7 will bring low oil shutdown member 110 into engagement with tappet 62 of valve 64, thereby unseating valve 64 during at least a portion of the compression and/or expansion cycles of piston 36 to vent gases either from or into combustion chamber 38, causing engine 20 to stall and eventually shut down. In this manner, low oil shutdown member 110 interrupts the running of engine 20 if the oil level in oil sump 32 falls below a level at which damage to engine 20 could potentially occur.

Figure 8:
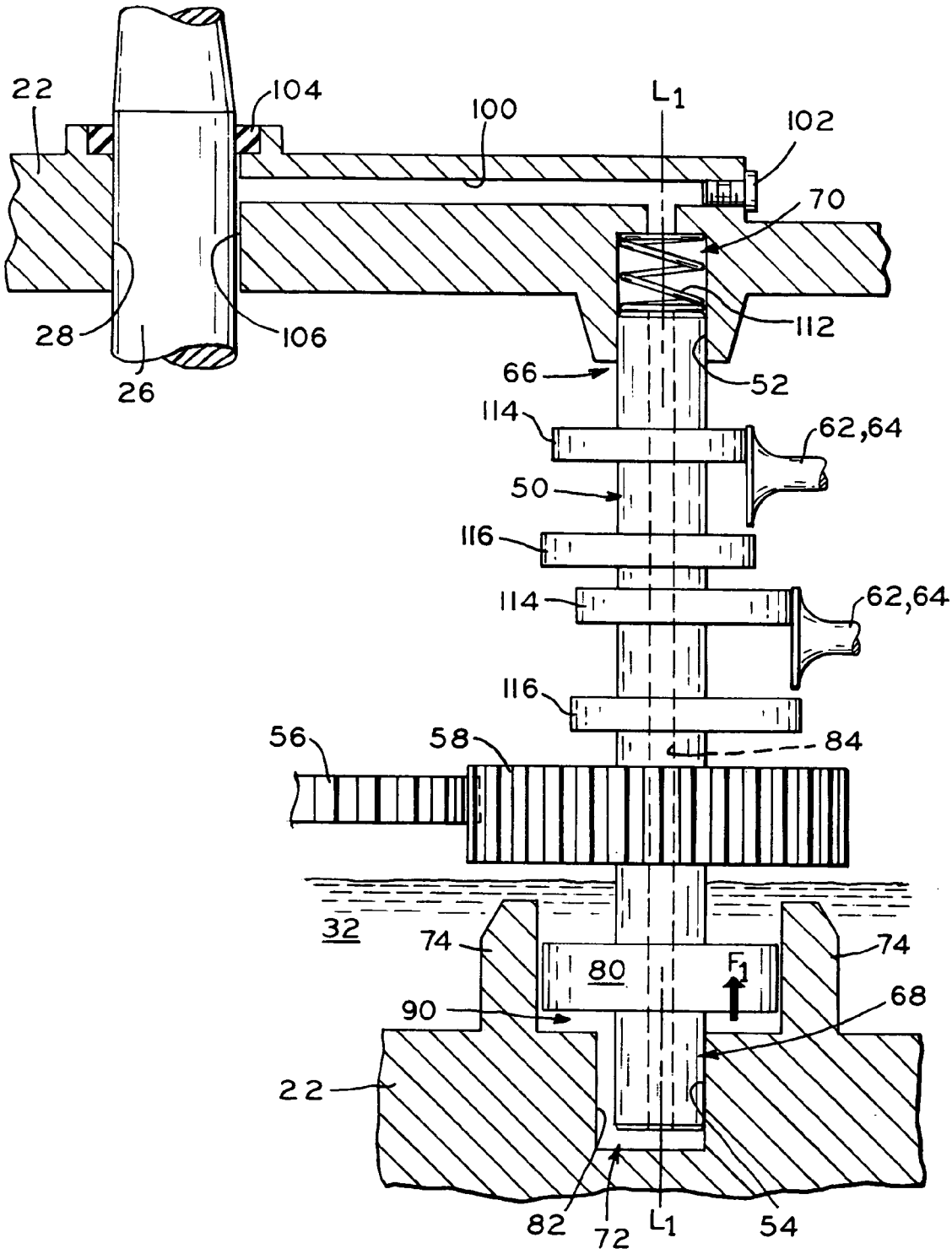
FIG. 8 is a sectional view along line 8—8 of FIG. 1A, wherein the translatable camshaft implements a low/high speed cam switching feature, the camshaft disposed in a first position corresponding to low engine speeds.
Figure 9:
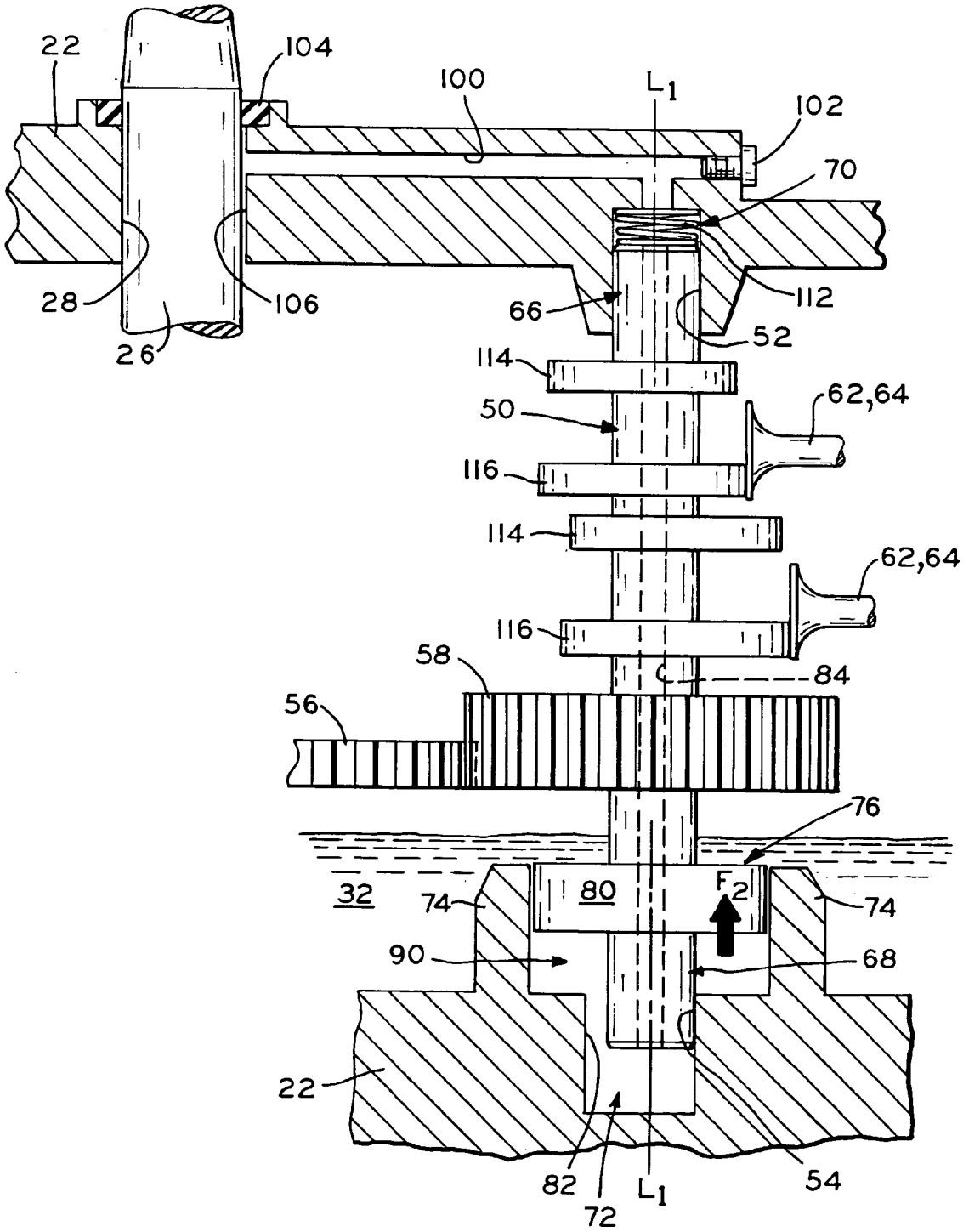
FIG. 9 is a sectional view along line 9—9 of FIG. 1A, showing the low/high speed cam switching feature of FIG. 8, the camshaft disposed in a second position corresponding to high engine speeds.

With reference to FIGS. 8 and 9, a low/high speed cam switching feature is shown. Referring to FIG. 8, at low engine speeds, camshaft 50 is disposed in its first or lower position as described above. Optionally, spring 112 may be provided, which is shown in FIGS. 8 and 9 captured under compression within clearance space 70 in upper camshaft bearing 52, and which biases camshaft 50 toward its first or lower position. At low engine speeds, one or more low speed cams 114 are in alignment with and engage tappets 62 of valves 64 to actuate valves 64 according to a first desired timing which corresponds to low running speeds of engine 20. For example, low speed cams 114 may have a first cam profile which corresponds to desired operating characteristics of the intake and exhaust valves 64 when engine 20 is running at low speeds.

When the speed of engine 20 increases to high speeds, camshaft 50 translates axially from its first or lower position, shown in FIG. 8, to its second or raised position, shown in FIG. 9, in the manner described above, shifting low speed cams 114 out of alignment with tappets 62 of valves 64 to disengage low speed cams 114, and concurrently shifting one or more high speed cams 116 into alignment and engagement with tappets 62 of valves 64. High speed cams 116 actuate valves 64 according to a second desired timing which corresponds to high running speeds of engine 20. For example, high speed cams 116 may have a second cam profile which corresponds to desired operating characteristics of the intake and exhaust valves 64 when engine 20 is running at high speeds.

When engine 20 returns to a lower speed, spring 112 and/or the weight of camshaft 50 overcomes the lesser oil pressure present in oil space 90 and its resulting force $F_1$, translating camshaft 50 from its second or upper position, shown in FIG. 9, back to its first or lower position, shown in FIG. 8, shifting high speed cams 116 out of alignment with tappets 62 of valves 64 to disengage high speed cams 116, and concurrently shifting low speed cams 114 back into alignment and engagement with tappets 62 of valves 64.

Although the axial translation of camshaft 50, and the various engine operational features which are facilitated thereby, are described above with camshaft 50 shown in a vertical orientation, camshaft 50 may also be oriented horizontally. When camshaft 50 is oriented horizontally, at least a portion of pump member 80 is in fluid communication with oil sump 32 of crankcase 24, such that pump member 80 may pump oil from oil sump 32 into oil space 90 to supply oil to the various lubrication points in engine 20, as well as to translate camshaft 50 axially in the manner described above. When camshaft 50 is oriented horizontally, gravity does not act upon camshaft 50 along longitudinal axis $L_1$—$L_1$ of camshaft 50, and a camshaft return spring 112 is usually required to bias camshaft 50 toward its first position.

Figure 10:
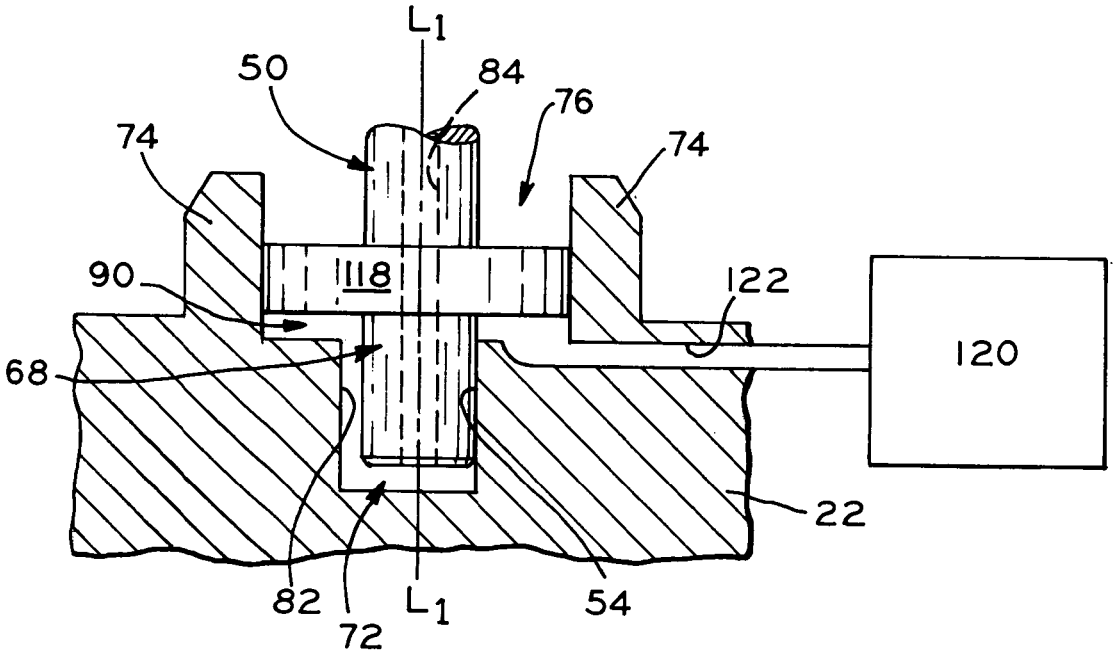
FIG. 10 is a sectional view of an alternate embodiment, showing an alternate method by which the camshaft may be translated.

In FIG. 10, an alternate embodiment is shown in which translation of camshaft 50 is effected in an different manner. In FIG. 10, camshaft 50 includes a solid plate member 118 in place of pump member 80, which is rotatable with camshaft 50 and is supported within cavity 76 to define oil space 90 in the same manner as described above with respect to pump member 80. An oil pump 120, such as a gerotor pump, a piston pump, or any other suitable pump, is in fluid communication with oil sump 32 and supplies oil from oil sump 32 to oil space 90 under pressure through an oil supply passage 122. In one embodiment, oil pump 120 may be separate from camshaft 50. For example, oil pump 120 may be driven from crankshaft 26. Alternatively, oil pump 120 may be driven from camshaft 50. For example, oil pump 120 may be located beneath lower camshaft bearing 54 and communicate with oil space 90 via oil supply passage 122.

At low engine speeds, oil pump 120 supplies oil to oil space 90 at a relatively low pressure, thereby generating a first, relatively, low oil pressure in oil space 90 beneath plate member 118 which is insufficient to translate camshaft 50. However, at high engine speeds, oil pump 120 supplies oil to oil space at a relatively greater pressure, thereby generating a second, relatively higher oil pressure in oil space 90 beneath plate member 118 which acts upon plate member 118 to translate camshaft 50 axially in the manner described above. In this manner, oil pump 120 may be used to supply pressurized oil to oil space 90 beneath plate member 118 at various pressures which are proportional to the speed of engine 20 in order to carry out any of the translation of camshaft 50 and the corresponding operational features of engine 20 which are described above. As will be apparent to one of ordinary skill in the art, the embodiment of FIG. 10 is applicable in either vertical or horizontal camshaft engines.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An internal combustion engine, comprising:

an engine housing;

a crankshaft, connecting rod, and piston assembly disposed within said engine housing, said piston reciprocatable within a cylinder bore to define a variable volume combustion chamber;

an oil sump disposed within said engine housing and containing oil;

a camshaft rotatably supported within said engine housing in timed driven relationship with said crankshaft at opposite ends of said camshaft within first and second bearings carried by said engine housing, said camshaft translatable axially between first and second positions, said camshaft further comprising:

at least one cam lobe periodically engaging a valve; and at least one auxiliary valve actuator axially spaced from said cam lobe, said auxiliary valve actuator engaging said valve in said first camshaft position and not engaging said valve in said second camshaft position; and an oil pump in fluid communication with said oil sump, oil pressure generated by said oil pump acting upon at least a portion of said camshaft to translate said camshaft from said first position to said second position at high engine speeds, said oil pressure insufficient at low engine speeds to translate said camshaft from said first position to said second position; and said camshaft further comprising a longitudinal bore therethrough, said bore fluidly communicating said first and second bearings with one another, said oil pump pumping oil from said first bearing to said second bearing through said bore.

2. The engine of claim 1, wherein said oil pump is separate from said camshaft, said oil pump in fluid communication with at least a portion of said camshaft via an oil supply passage.

3. The engine of claim 1, wherein said oil pump comprises an oil pump member mounted on said camshaft, said oil pump member rotatable with said camshaft to generate said oil pressure.

4. The engine of claim 3, wherein said oil pump member comprises an impeller including a body portion, said impeller generating oil pressure upon rotation of said camshaft which acts upon said body portion.

5. The engine of claim 1, wherein in said first camshaft position, said at least one auxiliary valve actuator engages said valve during a compression stroke of said piston to open said valve and vent pressure from said combustion chamber.

6. The engine of claim 1, wherein in said first camshaft position, said at least one auxiliary valve actuator engages said valve during an expansion stroke of said piston to open said valve and allow entry of fluid into said combustion chamber.

7. The engine of claim 1, wherein said camshaft includes a pair of said auxiliary valve actuators, wherein in said first camshaft position, one of said auxiliary valve actuators engages said valve during a compression stroke of said piston to open said valve and vent pressure from said combustion chamber and the other of said auxiliary valve actuators engages said valve during an expansion stroke of said piston to open said valve and allow entry of fluid into said combustion chamber.

8. The engine of claim 1, further comprising a spring disposed between said engine housing and said camshaft, said spring biasing said camshaft to said first position.

9. The engine of claim 1, wherein said second bearing is in fluid communication with a bearing of said crankshaft, said oil pump operable during running of said engine to pump oil to said crankshaft bearing from said second bearing.

10. An internal combustion engine, comprising:

an engine housing containing an oil sump having a volume of oil, said engine housing further including a cavity in fluid communication with said oil sump;

a crankshaft, connecting rod, and piston assembly disposed within said engine housing, said piston reciprocatable within a cylinder bore to define a variable volume combustion chamber;

a camshaft rotatably supported in said engine housing in timed driven relationship with said crankshaft in first and second bearings carried by said engine housing, said first bearing in fluid communication with said cavity, said camshaft translatable axially between a first position and a second position, said camshaft further comprising:

at least one cam lobe periodically engaging a valve;

an auxiliary valve actuator axially spaced from said cam lobe, said auxiliary valve actuator engaging said valve in said first camshaft position and not engaging said valve in said second camshaft position; and an oil pump member rotatably disposed within said cavity, oil pressure generated by said oil pump member acting upon said oil pump member at high engine speeds to translate said camshaft from said first position to said second position; and said camshaft further comprising a longitudinal bore therethrough which fluidly communicates said first bearing with said second bearing, said oil pump member pumping oil through said bore to said second bearing upon rotation of said camshaft.

11. The engine of claim 10, wherein said oil pump member comprises an impeller including a body portion and a plurality of impeller blades extending from said body portion.

12. The engine of claim 10, wherein in said first camshaft position, said at least one auxiliary valve actuator engages said valve during one of a compression stroke and an expansion stroke of said piston to open said valve and vent pressure from said combustion chamber.

13. The engine of claim 10, further comprising a spring disposed between said engine housing and said camshaft, said spring biasing said camshaft to said first position.

14. The engine of claim 10, wherein said second bearing is in fluid communication with a bearing of said crankshaft, said oil pump operable during running of said engine to pump oil to said crankshaft bearing from said second bearing.

* * * * *